US005164281A

United States Patent [19]

Hayakawa et al.

[11] Patent Number: 5,164,281

[45] Date of Patent: Nov. 17, 1992

[54] PHOTOSENSITIVE BODY FOR ELECTROPHOTOGRAPHY CONTAINING AMORPHOUS SILICON LAYERS

[75] Inventors: Takashi Hayakawa; Shoichi Nagata; Shiro Narukawa, all of Nara; Kazuki Wakita, Osaka; Kunio Ohashi; Yoshikazu Fujiwara, both of Nara, all of Japan

[73] Assignee: Sharp Kabushiki Kaisha, Osaka, Japan

[21] Appl. No.: 443,818

[22] Filed: Nov. 29, 1989

Related U.S. Application Data

[63] Continuation of Ser. No. 192,951, May 12, 1988, abandoned.

[30] Foreign Application Priority Data

May 15, 1987 [JP] Japan ..... 62-119199
May 18, 1987 [JP] Japan ..... 62-120525

[51] Int. Cl.[5] ..... G03G 5/14

[52] U.S. Cl. ..... 430/65; 430/66; 430/961

[58] Field of Search ..... 430/65, 66, 961

[56] References Cited

U.S. PATENT DOCUMENTS

| | | | |
|---|---|---|---|
| 4,088,485 | 5/1978 | Ing | 430/58 |
| 4,418,132 | 11/1983 | Yamazaki | 430/67 X |
| 4,600,672 | 7/1986 | Fujimura | 430/64 |
| 4,613,556 | 9/1986 | Mort | 430/66 X |
| 4,634,647 | 1/1987 | Jansen et al. | 430/37 X |
| 4,713,309 | 12/1987 | Johncock | 430/66 X |
| 4,775,606 | 10/1988 | Shirai | 430/67 |

*Primary Examiner*—J. David Welsh
*Attorney, Agent, or Firm*—Flehr, Hohbach, Test, Albritton & Herbert

[57] ABSTRACT

A photosensitive body for electrophotography has as its principal constituent a photoconductive layer having amorphous silicon with hydrogen, a surface layer having a greater optical band gap than the photoconductive layer formed on a photoconductive base member, and an intermediate layer sandwiched therebetween.

9 Claims, 1 Drawing Sheet

PHOTOSENSITIVE BODY FOR ELECTROPHOTOGRAPHY CONTAINING AMORPHOUS SILICON LAYERS

This is a continuation of application Ser. No. 192,951 filed May 12, 1988, to be abandoned.

BACKGROUND OF THE INVENTION

This invention relates to a photosensitive body for electrophotography and more particularly to a photosensitive body with a photoconductive layer composed mainly of amorphous silicon.

Basic requirements for a photosensitive body to be practical and useful in electrophotography include high resistivity and high photosensitivity. As materials having these required characteristics, the following two types of materials have been most commonly utilized, the dispersed resin type obtained by dispersing cadmium sulfide powder in an organic resin and the amorphous type such as amorphous selenium (a-Se) and amorphous arsenic selenide (a-$As_2Se_3$). These materials are not satisfactory for reasons of their environmental effects, however, and development of their substitute materials is desired. In recent years, amorphous silicon is seriously considered as such a substitute material.

Not only is amorphous silicon environmentally harmless but its photosensitivity is high and it is also a very hard material. Because of these favorable characteristics, amorphous silicon is expected to be usable as a superior material for a photosensitive body. If amorphous silicon is used alone, however, the value of its resistivity is not high enough to retain electric charges during an electrophotographic process. In order that amorphous silicon be used in a photosensitive body for electrophotography, therefore, something must be done such that a high charge voltage can be maintained without adversely affecting its high photosensitivity.

One of the attempts to this end was to increase the resistance of an amorphous silicon layer itself which serves as the photosensitive body. In order to effectively make use of the superior photoconductive characteristics of amorphous silicon (such as strong optical absorption, relatively large electron and pole mobilities and long-wavelength sensitivity), however, it is more desirable to provide a blocking layer with a large energy band gap on the surface (and the base member) to prevent the charge from escaping rather than to increase the resistance of the photoconductive layer itself so as to improve its capability to be charged. Such a surface layer of the type having a large energy band gap may be considered indispensable not only for keeping charges but for establishing surface stability as a surface protective film which not only protects the photosensitive body from severe bombardments of corona ions during an electrophotographic process but also reduces the variations in the characteristics due to changes in environmental conditions such as temperature and humidity. To serve as a surface protective film, surface layers with a larger energy band gap are naturally more desirable.

As described above, it is generally to be considered desirable to provide a surface layer with a large energy band gap not only for keeping charges but also from the point of view of surface protection. If a layer with a large energy band gap is formed immediately on the surface of amorphous silicon forming an electroconductive layer, however, there appear characteristics which are undesirable for a photosensitive body for electrophotography. One of such undesirable characteristics is mechanical instability. If a surface layer with a large energy gap is formed on an amorphous silicon photoconductive layer, stable adhesion cannot be obtained between the surface layer and the photoconductive layer because of their difference in coefficient of thermal expansion.

Electrically undesirable characteristics also appear if a surface layer with a large energy band gap is directly formed on a photoconductive layer. If the surface area of a photosensitive body which is preliminarily charged is exposed to light in an electrophotographic process, charges of polarity opposite to those on this surface layer are generated in the photoconductive layer and these generated charges move through the photoconductive layer, cancelling the surface charges electrostatically. If the energy band gap of the surface layer is large as explained above, however, the gap becomes very large at the boundary between them and charges cannot move smoothly. As a result, these charges become accumulated near the boundary surface between the surface layer and the photoconductive layer and their effect appears as a residual potential. The residual potential is not a desirable thing. If the residual potential increases, it can cause deterioration of the characteristics of the photosensitive body. Moreover, the residual potential frequently induces movement of accumulated carriers in transverse directions, causing fogginess in the image.

In short, although a surface layer with a large energy band gap is indispensable from the point of view of charge retention and surface protection, it causes both mechanical and electrical problems, and no photosensitive body of amorphous silicon satisfactory for electrophotography has been available yet.

Moreover, conventional photosensitive bodies for electrophotography with a photoconductive layer having amorphous silicon as the principal constituent can be charged only positively or negatively. Thus, the carrier mobility in the photoconductive layer can be large only for holes in the case of a photosensitive body intended to be charged positively and only for electrons in the case of a photosensitive body intended to be carged negatively. U.S. Pat. No. 4,613,556 issued Sep. 23, 1986 to Mort et al. describes an amorphous silicon photosensitive body for electrophotography which can be charged in both positive and negative modes. This photosensitive body is a device with a hydrogenated amorphous silicon photosensitive layer and a charge transporting layer of plasma deposited amorphous silicon oxide. The charge transport channels in the silicon oxide layer or the charge transport manifold accepts photo-excited carriers in the hydrogenated amorphous silicon to provide the ambipolar nature, that is, the photosensitivity in both the positive and negative charging modes. In other words, there has been no photosensitive body available for electrophotography with sufficiently large mobilities for both holes and electrons. As a result, there could be no photosensitive body available with superior sensitivity both when charged positively and negatively.

SUMMARY OF THE INVENTION

It is therefore an object of the present invention to provide an improved photosensitive body for electrophotography comprised of a photoconductive layer having amorphous silicon as its principal constituent and a surface layer having a larger optical band gap than the photoconductive layer such that high residual potential and ill effects on an image caused thereby can be prevented.

It is another object of the present invention to provide a photosensitive body for electrophotography which can be effectively charged both positively and negatively.

It is a further object of the present invention to provide a photosensitive body for electrophotography with which a high-quality image can be obtained not only initially but also even after as many as 300,000–500,000 copies are made.

A photosensitive body for electrophotography embodying the present invention, with which the above and other objects can be achieved, is characterized as having an intermediate layer satisfying certain conditions between a surface layer and a photoconductive layer.

BRIEF DESCRIPTION OF THE DRAWING

The accompanying drawing which shows the structure of a photosensitive body for electrophotography embodying the present invention is incorporated in and form a part of the specification and, together with the description, serves to explain the principles of the invention.

DETAILED DESCRIPTION OF THE INVENTION

Figure 1:
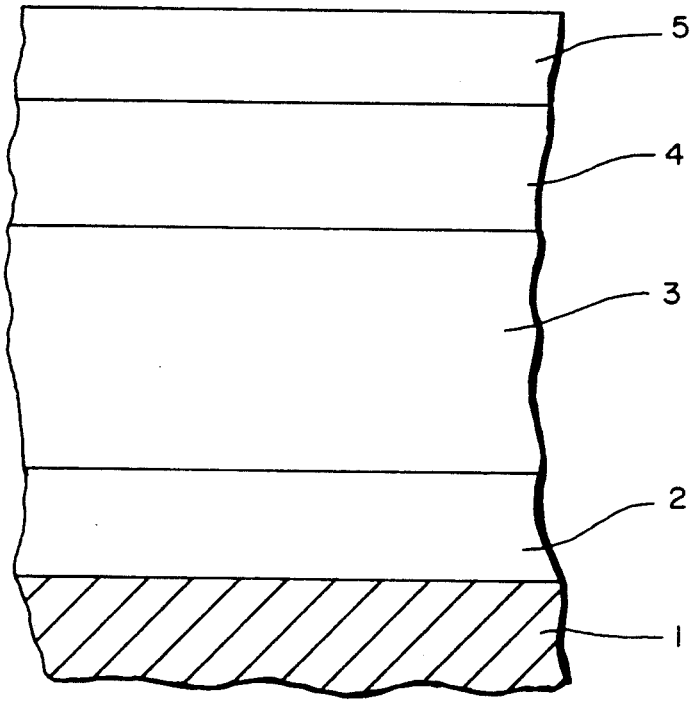

The structure of a photosensitive body for electrophotography embodying the present invention is shown in FIG. 1 wherein numeral 1 indicates an electroconductive base member, numeral 2 indicates a lower layer, numeral 3 indicates a photoconductive layer, numeral 4 indicates an intermediate layer and numeral 5 indicates a surface layer (or a surface blocking layer). The lower layer 2 is not an indispensable component of the present invention. According to one embodiment of the present invention, this lower layer 2 is comprised of amorphous silicon containing nitrogen and the surface layer 5 is comprised of amorphous silicon containing carbon. The conditions under which the layers are formed are as follows. For the lower layer 2, flow rate of $SiH_4$=300sccm, flow rate of $NH_3$ or NO=30sccm, RF power=500W, temperature of base member=270° C., pressure=1 torr, and film thickness=0.5–5μm; for the photoconductive layer 3, flow rate of $SiH_4$=300sccm, flow rate of $B_2H6$(0.03% in H2) 10sccm, flow rate of $PH_3$(0.03% in H2) 1sccm, RF power=500W, temperature of base member=270° C., pressure=1 torr, and film thickness=25μm; for the intermediate layer 4, flow rate of $SiH_4$=300sccm, flow rate of $B_2H_6$(0.03% in $H_2$)=150sccm, flow rate of $PH_3$(0.03% in $H_2$) 15sccm, RF power 500W, temperature of base member 270° C., pressure=1 torr, and film thickness=1–2μm; and for the surface layer 5, flow rate of $SiH_4$=10sccm, flow rate of $CH_4$=300sccm, RF power=100W, temperature of base member 270° C., pressure 0.5 torr, and film thickness=0.1–0.5μm.

A photosensitive body fabricated under the conditions given above was installed for testing in a copier adapted to charge it positively. Not only was it found that high-quality images without fogginess or transverse movements obtained initially but neither the characteristics of the photosensitive body or the quality of the produced image deteriorated after as many as 300,000 sheets of copy paper were processed. A similar test was conducted by installing the same photosensitive body in another copier adapted to charge it negatively and identically favorable results were obtained. It is to be noted that the contents of B and P in the intermediate layer 4 are greater respectively than those in photoconductive layer 3, and that the level density in the band gap of the intermediate layer 4 is greater than that of the photoconductive layer 3.

As another example, the intermediate layer 4 was formed under the following different conditions: flow rate of $SiH_4$=300sccm, flow rate of $CH_4$=30sccm, flow rate of $B_2H6$(0.3% in $H_2$)=100sccm, flow rate of $PH_3$(0.3% in $H_2$)=50sccm, PF power=500W, temperature of base member=270° C., pressure=1 torr, and film thickness=1–2 μm such that it contains at least Si, C, H, P and B. Photosensitive bodies thus formed were also tested similarly with copiers adapted to give positive and negative charges and by processing about 500,000 sheets of copy paper. Similar results showing improvements over prior art photosensitive bodies were obtained.

The foregoing description of preferred embodiments of the invention has been presented for purposes of illustration and description. It is not intended to be exhaustive or to limit the invention to the precise form disclosed, and many modifications and variations are possible in light of the above teaching. Such modifications and variations that may be apparent to a person skilled in the art are intended to be included within the scope of this invention.

What is claimed is:

1. A photosensitive body for electrophotography comprising an electroconductive base member, a photoconductive layer comprising amorphous silicon containing P and B, a surface layer of amorphous silicon containing carbon and having a greater optical band gap than said photoconductive layer, and an intermediate layer formed between said photoconductive layer and said surface layer, said intermediate layer comprising amorphous silicon containing P, B and C, said intermediate layer containing more P and B than said photoconductive layer does, the level density in optical gap in said intermediate layer being greater than that in said photoconductive layer such that said photosensitive body has improved photosensitivity both when positively and negatively charged.

2. The photosensitive body of claim 1 wherein said surface layer contains silicon and carbon.

3. The photosensitive body of claim 1 wherein said intermediate layer comprises as principal constituent thereof amorphous silicon containing at least Si, C, H, P and B.

4. The photosensitive body of claim 1 further comprising a lower layer formed between said base member and said photoconductive layer.

5. The photosensitive body of claim 4 wherein said lower layer comprises amorphous silicon containing nitrogen.

6. The photosensitive body of claim 1 wherein said photoconductive layer is about 25μm in thickness.

7. The photosensitive body of claim 1 wherein said intermediate layer is 1–2μm in thickness.

8. The photosensitive body of claim 1 wherein said surface layer is 0.1–0.5μm in thickness.

9. The photosensitive body of claim 7 wherein said surface layer is 0.1–0.5μm in thickness.

* * * * *